US006733336B1

(12) United States Patent
Montena et al.

(10) Patent No.: US 6,733,336 B1
(45) Date of Patent: May 11, 2004

(54) COMPRESSION-TYPE HARD-LINE CONNECTOR

(75) Inventors: Noah Montena, Syracuse, NY (US); Eric J. Purdy, Constantia, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/406,741

(22) Filed: Apr. 3, 2003

(51) Int. Cl.[7] ..... H01R 9/05

(52) U.S. Cl. ..... 439/578; 439/585; 439/63; 439/675

(58) Field of Search ..... 439/578, 582, 439/583, 584, 585, 675, 63, 252, 271, 274, 310, 320, 323, 306

(56) References Cited

U.S. PATENT DOCUMENTS

| | | | | | |
|---|---|---|---|---|---|
| 3,603,912 | A | | 9/1971 | Kelly | |
| 4,583,811 | A | | 4/1986 | McMills | |
| 4,648,684 | A | | 3/1987 | Mattis | |
| 4,655,159 | A | | 4/1987 | McMills | |
| 4,717,355 | A | | 1/1988 | Mattis | |
| 4,854,893 | A | * | 8/1989 | Morris | 439/578 |
| 4,923,412 | A | * | 5/1990 | Morris | 439/578 |
| 5,011,432 | A | * | 4/1991 | Sucht et al. | 439/584 |
| 5,127,853 | A | * | 7/1992 | McMills et al. | 439/578 |
| 5,352,134 | A | * | 10/1994 | Jacobsen et al. | 439/584 |
| 5,499,934 | A | | 3/1996 | Jacobsen | |
| 5,571,028 | A | | 11/1996 | Szegda | |
| 5,632,651 | A | | 5/1997 | Szegda | |
| 5,651,698 | A | * | 7/1997 | Locati et al. | 439/578 |
| 6,089,913 | A | | 7/2000 | Holliday | |
| 6,095,858 | A | | 8/2000 | Emery | |
| 6,102,738 | A | | 8/2000 | Macek | |
| 6,109,964 | A | | 8/2000 | Kooiman | |
| 6,123,567 | A | | 9/2000 | McCarthy | |
| 6,126,482 | A | | 10/2000 | Stabile | |
| 6,146,197 | A | | 11/2000 | Holliday | |
| 6,165,019 | A | | 12/2000 | Kha | |
| 6,206,727 | B1 | | 3/2001 | Aoyama | |
| 6,210,221 | B1 | | 4/2001 | Maury | |
| 6,217,380 | B1 | | 4/2001 | Nelson | |
| 6,217,382 | B1 | | 4/2001 | Ziers | |
| 6,223,826 | B1 | | 5/2001 | Chau | |
| 6,264,503 | B1 | | 7/2001 | Emery | |
| 6,315,585 | B1 | | 11/2001 | Oka | |
| 6,322,390 | B1 | | 11/2001 | Takeuchi | |
| 6,331,123 | B1 | | 12/2001 | Rodrigues | |
| 6,352,448 | B1 | | 3/2002 | Holliday | |
| 6,361,364 | B1 | | 3/2002 | Holland | |
| 6,383,019 | B1 | | 5/2002 | Wild | |
| 2001/0034158 | A1 | | 10/2001 | Matsubara | |
| 2001/0053629 | A1 | | 12/2001 | Togashi | |

* cited by examiner

*Primary Examiner*—P. Austin Bradley
*Assistant Examiner*—Edwin A. Leon
(74) *Attorney, Agent, or Firm*—Christopher R. Pastel; Hancock & Estabrook, LLP

(57) ABSTRACT

The present invention provides a connector used to interconnect a hard-line coaxial cable to an equipment port. The connector of the present invention essentially comprises a main connector body in which the various connecting and sealing members are housed, and a compression body attached to the connector body for axial, sliding movement between first and second terminal positions relative to the connector body. The port side of the connector includes a conductive pin extending axially outwardly therefrom that is adapted to be inserted into the port provided in the equipment box, and an axially extending bore is formed though the distal end (cable side) of the connector and compression bodies for receiving the central conductor of the hard-line cable therein.

50 Claims, 17 Drawing Sheets

COMPRESSION-TYPE HARD-LINE CONNECTOR

BACKGROUND OF THE INVENTION

The present invention relates generally to co-axial cable connectors, and more particularly to such connectors used with hard-line co-axial cables.

Co-axial cable is a typical transmission medium used in communications networks, such as a CATV network. The cables comprising the transmission portion of the network are typically of the "hard-line" type, while those used to distribute the signals into residences and businesses are typically "drop" connectors. The principal difference between hard-line and drop cables, apart from the size of the cables, is that the hard-line cables include a rigid or semi-rigid outer cable (typically covered with a weather protective jacket) that effectively prevents radiation leaking and protects the inner conductor and dielectric, while the drop cables include a relatively flexible outer conductor, typically braided, that permits their bending around obstacles between the transition or junction box and the location of the device to which the signal is being carried, i.e., a television, computer, and the like. Drop cables are less effective than hard-line cables at preventing radiation leakage. Hard-line conductors, by contrast, generally span considerable distances along relatively straight paths, thereby greatly reducing the need for a cable's flexibility. Due to the differences in size, material composition, and performance characteristics of hard-line and drop cables, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port, and without disrupting the ground connection of the cable. This requires a skilled technician to effect the interconnection.

A typical type of interconnect device used to connect a transmission cable to an equipment port is of the threaded type. The technician must prepare the cable in the standard manner, i.e., stripping the various layers of the cable to their predetermined distances and furrowing out the dielectric material over a predetermined distance in order to bottom out the inner conductor until it is seized by the conductive pin that will carry the signal through the port, and use a wrench to provide torque that will radially compress and seal portions of the connector into the outer jacket of the transmission cable. Such types of connector rely heavily on the skill of the technician in applying the proper amount of torque to effect the connections, thereby making reliability of signal integrity a concern.

In addition to the need for a skilled technician in effecting the connection between the transmission cable and the equipment port, such threaded connectors also require that the transmission cable be separated from the connector the equipment housed in the box needs to be serviced or maintained. It also is difficult to fit a wrench into the space provided by many equipment ports, thereby making the technician's job that uses threaded connectors even more difficult.

Another type of standard connector used with transmission cables are of the crimping type. With crimp connectors, the technician uses a crimping tool that radially surrounds the connector after the cable has been bottomed out therein, and radially crimps the connector body into engagement with the cable's outer jacket. While such connectors eliminate the difficulties associated with the threaded connectors, the crimping action often produces inconsistent electrical connection between the connector and the cable, is less effective at preventing moisture migration, and also degrades the cable's outer conductor, thereby creating signal losses that ultimately reduce the quality of the signal being transmitted.

A compression type connector usable on hard-line cables is disclosed in U.S. Pat. No. 6,331,123. Compression connectors utilize a compression member that is axially slidable into the connector body for radially displacing connecting and sealing members into engagement with the hard-line cable's outer conductor. A compression tool that slides the compression body into the connector is utilized by the technician to effect the connection, and due to the physical constraints of the compression member and connector body, it is impossible for the technician to use too much force to effect the interconnection. Thus, compression connectors eliminate the assembly drawbacks associated with threaded, and to some degree, crimp type connectors.

It is a principal object and advantage of the present invention to provide a compression type connector for use on hard-line cables.

It is another object and advantage of the present invention to provide a compression type connector that reliably effects interconnection between a hard-line cable and an equipment port.

It is an additional object and advantage of the present invention that reduces technician errors associated with connecting a hard-line cable to an equipment port.

It is a further object and advantage of the present invention to provide a compression type connector for use with hard-line cables that may be inexpensively manufactured with a minimum of waste material.

Other objects and advantages of the present invention will in part be obvious, and in part appear hereinafter.

SUMMARY OF THE INVENTION

In accordance with the foregoing objects and advantages, the present invention provides a connector used to interconnect a hard-line co-axial cable to an equipment port. The connector of the present invention essentially comprises a main connector body in which the various connecting and sealing members are housed, and a compression body attached to the connector body for axial, sliding movement between first and second terminal positions relative to the connector body. The port side (also referred to herein as the "proximal" end) of the connector includes a conductive pin extending axially outwardly therefrom that is adapted to be inserted into the port provided in the equipment box, and an axially extending bore is formed through the distal end (cable side) of the connector and compression bodies for receiving the central conductor of the hard-line cable therein. A collet electrically connected to the conductive pin seizes the central conductor when it is fully inserted through the axial bore, thereby electrically interconnecting the conductor to the conductive pin that ultimately carries the signal to/from the equipment mounted in the box. A nut is rotatably attached to the proximal end of the connector body and serves to connect the connector body to the equipment port.

After preparing the cable using industry standard preparation tools, the central conductor is fully inserted in the axial bore, the outer conductor of the hard-line cable is positioned annularly between a mandrel that is housed within the connector body and various clamping and sealing members. An industry standard compression tool may then be used by a technician to axially slide the compression body into the connector body. As the compression body slides into to the connector body its ramped, leading face engages a correspondingly ramped surface of a clamping and sealing member. The co-acting ramped surfaces cause the clamping and sealing member to deflect radially inwardly until it contacts the outwardly facing surface of the outer conductor (and possibly a potion of the jacket coating the outer conductor).

The proximal end of the compression body then engages an RF seal driver (that may be an integral part of the clamping and sealing member), and drives it axially within the connector body. As the RF seal driver slides axially in the connector body (as a result of being pushed by the compression body), its proximal end surface engages the distal end surface of the RF seal and drives the RF seal axially. The RF seal includes a portion of its outwardly facing surface that is ramped, and as it is forced axially, the ramped portion of the RF seal engages a correspondingly ramped surface formed on the inwardly facing surface of the connector body. The ramped surface on the connector body forces the RF seal radially inwardly towards the outwardly facing surface of the hard-line cable's outer conductor. Upon termination of the axial movement of the compression body, the hard-line cable's outer conductor is sandwiched between the RF seal and the mandrel, and the jacket coating the outer conductor is sandwiched between the clamping and sealing member and the mandrel.

Alternatively, the proximal end surface of the compression body may serve as the RF seal driver. In this arrangement, the proximal end of the compression body pass entirely over the clamping and sealing member and engages the distal end surface of the RF seal in order to drive it axially. Alternate embodiments of the RF seal are also disclosed, as is connector body having a port side that is offset 90 degrees relative to its cable side.

BRIEF DESCRIPTION OF THE DRAWINGS

The present invention will be better understood and more fully appreciated by reading the following Detailed Description in conjunction with the accompanying drawings, in which.

DETAILED DESCRIPTION

Figure 1:
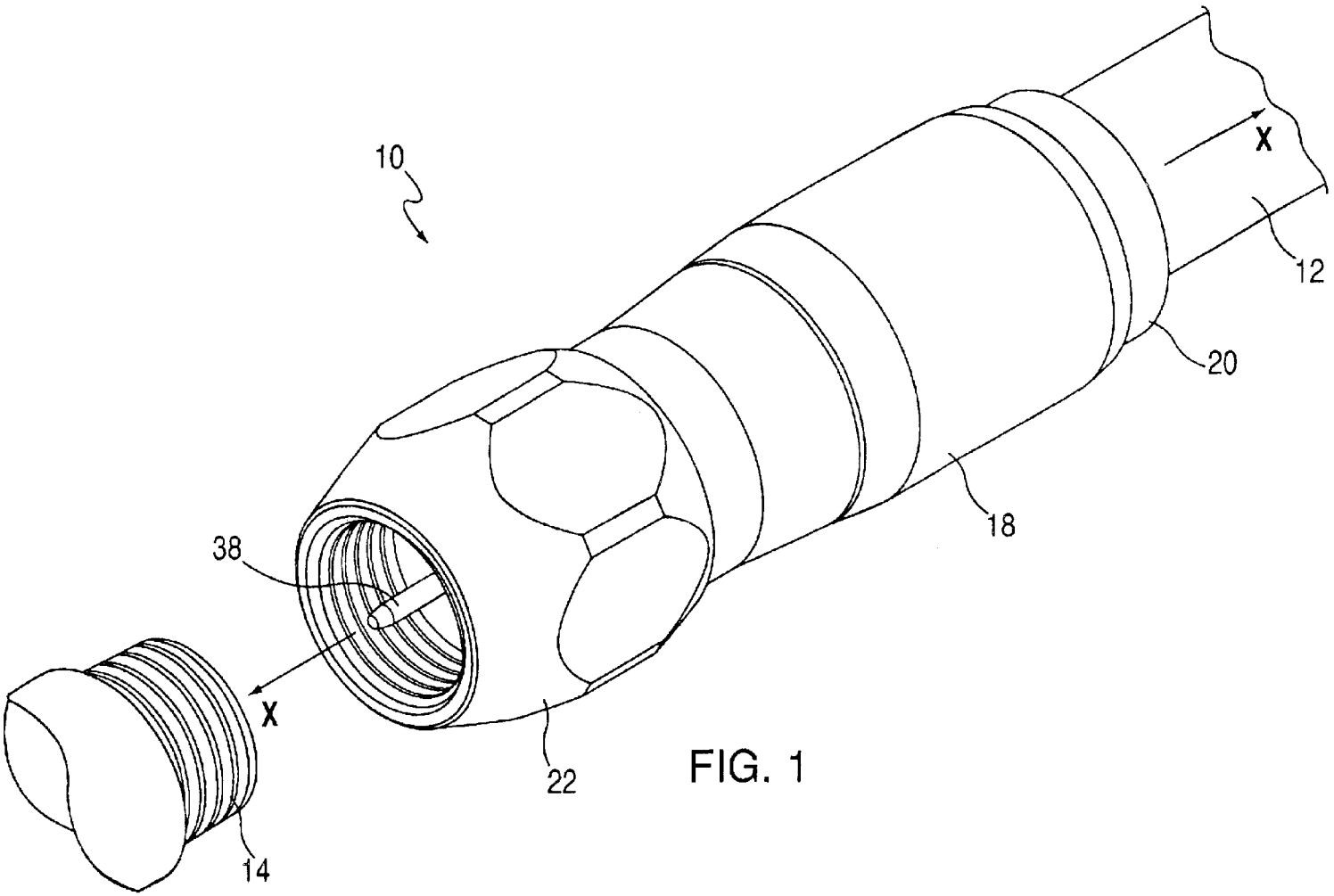
FIG. 1 is a perspective view of a preferred embodiment of a hard-line co-axial cable connector.
Figure 2:
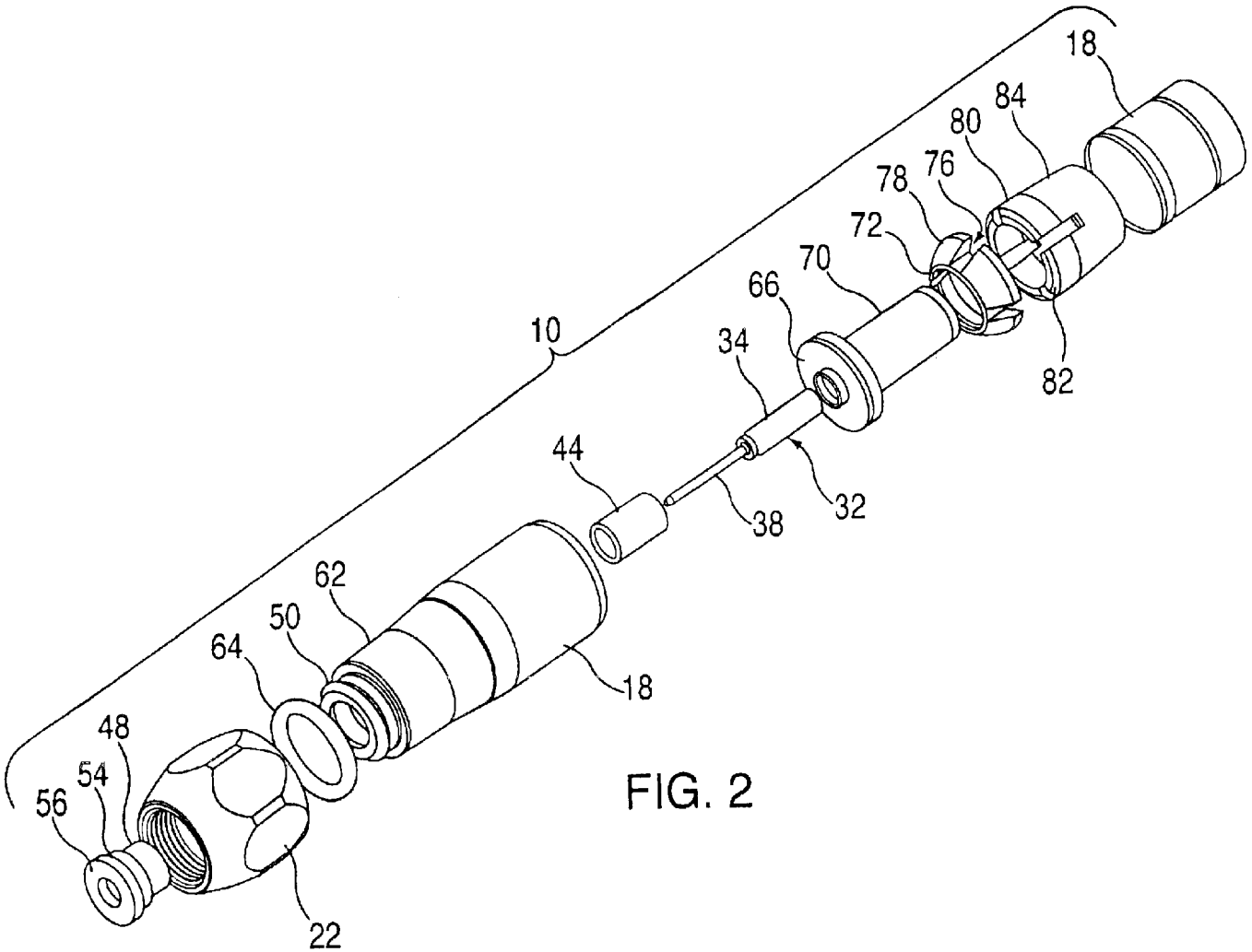
FIG. 2 is an exploded perspective view thereof.
Figure 3A:
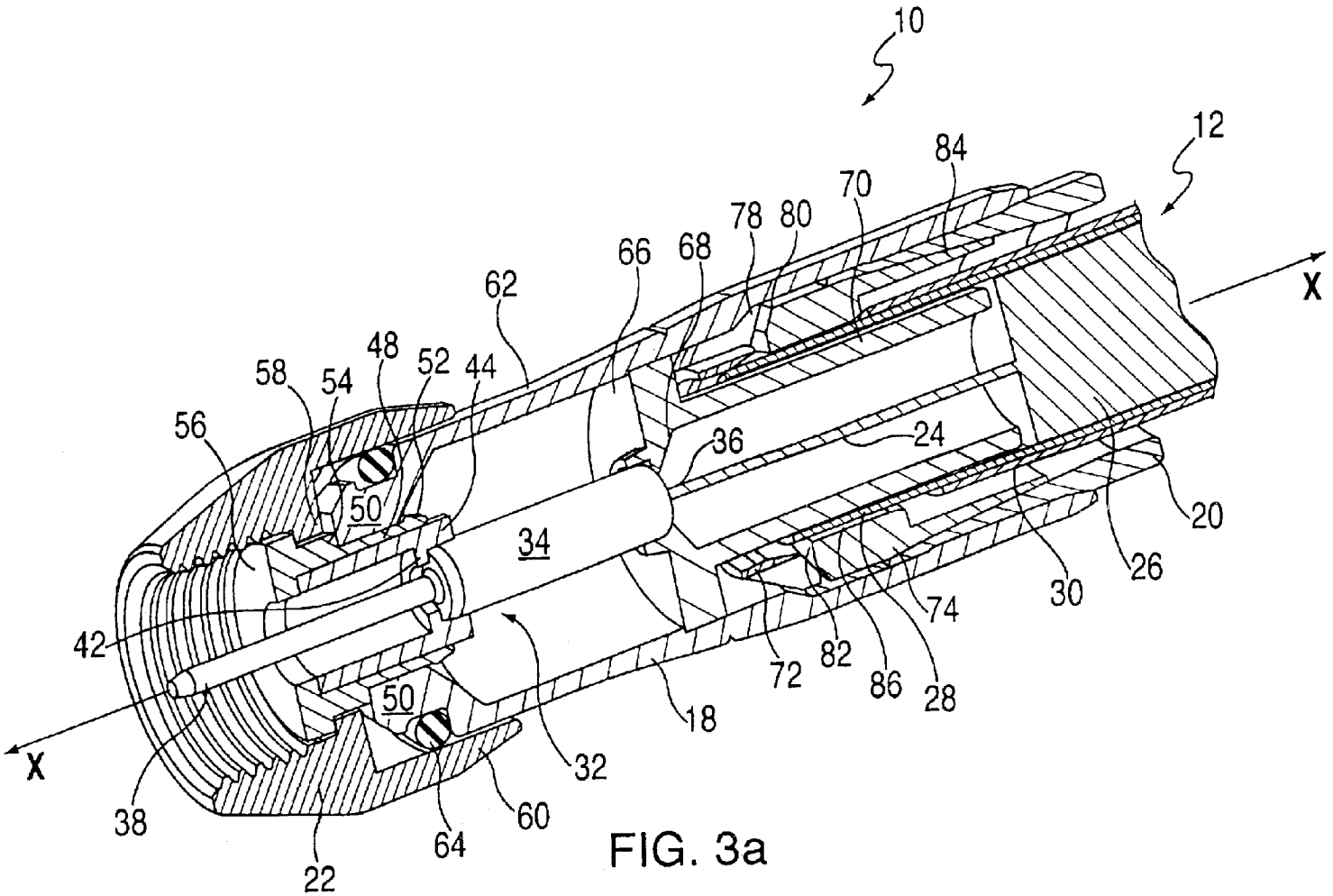
FIGS. 3*a* and 3*b* are a cross-sectional views thereof taken along line 3—3 of FIG. 1, showing the connector in its uncompressed and compressed positions, respectively.

Referring now to the drawing figures, wherein like reference numerals refer to like parts throughout, there is seen in FIG. 1 a connector, designated generally by reference numeral 10, for use in interconnecting a hard-line co-axial cable 12 to a port 14 of an equipment box 16. Connector 10 generally comprises a body 18 that extends along longitudinal axis X—X, a compression member 20 connected to body. 18 for axial movement relative thereto between first (uncompressed, See FIG. 3*a*) and second (compressed, See FIG. 3*b*) positions, and a coupling nut 22 for interconnecting body 18 to port 14.

Co-axial cable 12 is a conventional hard-line cable, such as a QR, P1, P2, P3, or TX type cable, among other industry standard cables, comprising a central conductor 24, typically a signal carrying conductor, that is radially surrounded by a layer of dielectric material 26, such as polyethylene, polytetrafluoroethylene, and the like, an outer conductor 28, typically a ground conductor, radially surrounding the dielectric material 26 and extending co-axially with central conductor 24, and an outer jacket 30 that surrounds outer conductor 28 and protects it from inclement weather, among other things. Hard-line cable is commonly used as the distribution medium in a CATV network, and is well understood in the art.

Connector 10 further comprises a collet assembly 32 co-axially positioned within body 18. Collet assembly 32 includes a cable seizing element 34 composed of an electrically conductive material, such as brass, that includes a central opening 36 through which central conductor 24 may pass with an interference fit, and a contact pin 38 electrically connected to and extending axially from seizing element 34 towards the proximal end (port side) of connector 10. Contact pin 34 carries the signal from central conductor 24 through port 14 to the equipment contained within box 16.

Collet assembly 32 is maintained in position within body 18 by a tubular insulator that includes a flange 42 that engages the outwardly facing, proximal end surface of seizing member 34, and a distal lip portion 44 that is securely annularly engaged with the outwardly facing surface of seizing member 34. The remainder of insulator 40 extends axially towards the proximal end of body 18.

To maintain insulator 40 in position within body 18, and to securely interconnect coupling nut 22 to body 18, a retaining nut 46 is used. Retaining nut 46 includes a terminal leg 48 that is tightly sandwiched between the proximal end portion 50 of body 18 and insulator 40, thereby maintaining insulator 40 in fixed relation relative to body 18. A flanged lip 52 at the distal end of terminal leg 48 engages the inner surface of proximal end portion 50 to prevent inadvertent dislodgement of retaining nut 46 from body 18.

An intermediate leg 54 of retaining nut 46 is of a greater diameter than, and extends proximally from terminal leg 48, and engages the outwardly facing surface of body 18 at the neck interface of the two leg portions. Finally, the proximal end 56 of retaining nut 46 is of a diameter greater than that of intermediate leg 54, and engages an inner flange 58 formed in coupling nut 22 to prevent nut 22 from becoming disassociated from body 18, as further described below.

During assembly, the distal region 60 of coupling nut 22 is slid over the proximal end portion 50 and intermediate region 62 of body 18. Due to intermediate region 62 being of a larger diameter than proximal end portion 50, an annular space exists between distal region 60 and proximal end portion 50. To seal out moisture and other contaminants from migrating between coupling nut 22 and proximal end portion 50, an O-ring 64 is sealingly positioned therebetween (ring 64 actually sits in a notch formed in the outwardly facing surface of proximal end portion 50). The interconnection between coupling nut 22 and body 18 is tight enough to maintain a predominantly sealed connection, but loose enough to permit coupling nut 22 to be rotated about axis X—X independent of body 18, and threaded onto or off of port 14.

Returning to connector 10, it further comprises a conductor centering guide 66 annularly positioned around the open end 36 of collet assembly 34, and that includes an inwardly tapering surface 68 that guides central conductor 24 through opening 36 and into seizing member 34. Centering guide 66 extends radially outwardly from seizing member 34 into engaged relation with the inner surface of body 18, thereby fixing its position relative to body 18.

Extending distally from centering guide 66 is a tubular mandrel 70. Centering guide 66 and mandrel 70 are illustrated in the drawing figures as being an integral unit, but it should be understood that they could be manufactured as separate components as well.

When compression member 20 is in its uncompressed position, connector 10 further comprises an RF seal 72 positioned co-axially with, and in annularly spaced relation to the outwardly facing surface of mandrel 70, and a clamping member 74 also positioned co-axially with, and in annularly spaced relation to the outwardly facing surface of mandrel 70. RF seal 72 becomes radially compressed into sealing engagement with the outer surface of outer conductor 28, and clamping member 74 becomes radially compressed into clamping relation to the outer surface of jacket 30 when compression member 20 is axially moved to its second (fully compressed) position, as will be described in greater detail hereinafter.

Figures 3B, 4:
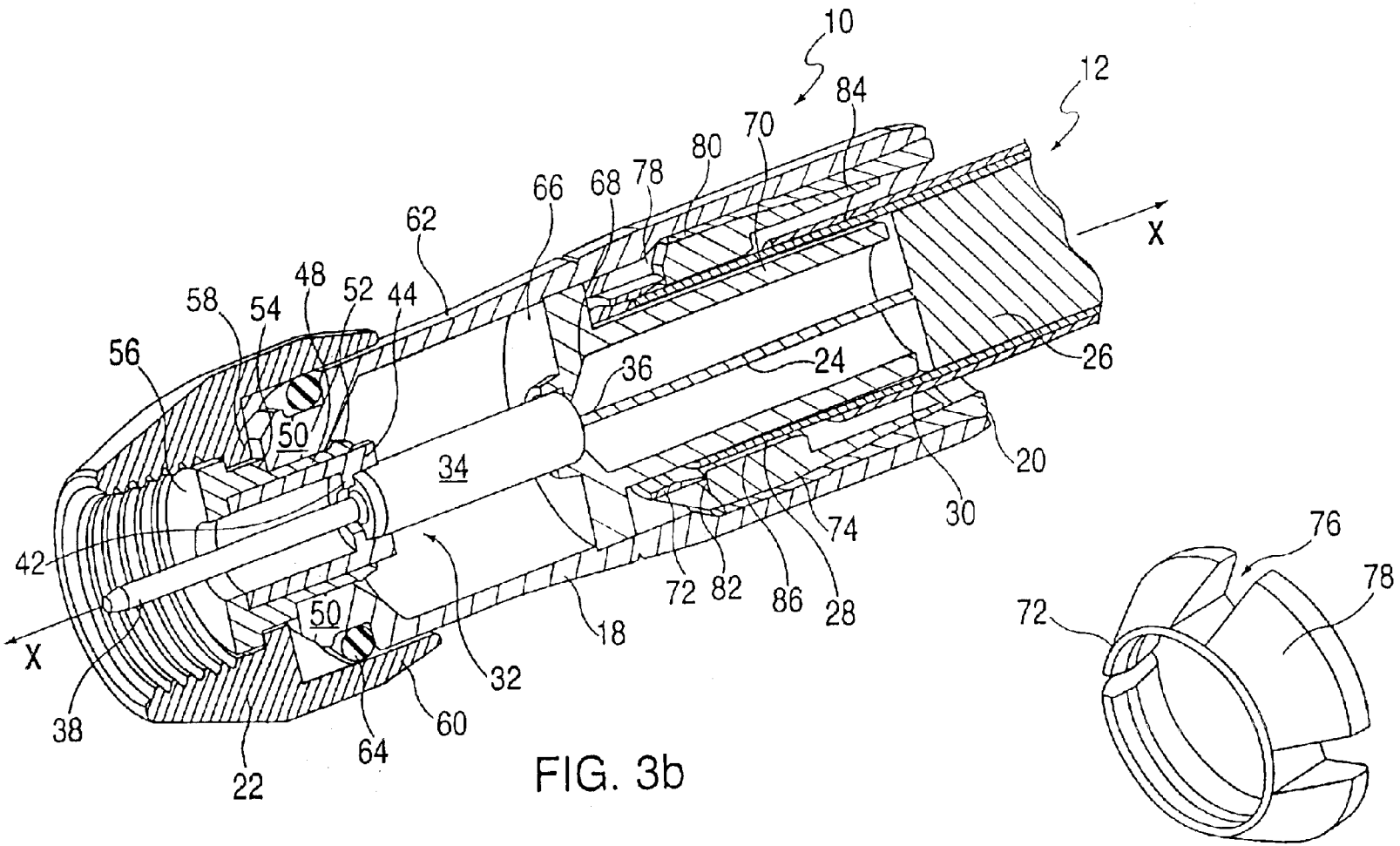
FIG. 4 is a perspective view of the RF seal of the preferred embodiment.

With reference to FIG. 4, RF seal 72 is composed of a conductive material, such as brass, formed in a ring with a series of annularly spaced notches 76 removed therefrom which define annularly spaced segments 78. Segments 78 include a distal surface that ramps upwardly towards the distal end of body 18. When placed in contacting relation with outer conductor 28, RF seal 72 sandwiches the conductor between itself and mandrel 70, and also prevents undesirable levels of RF radiation from leaking from cable 12.

Figure 5:
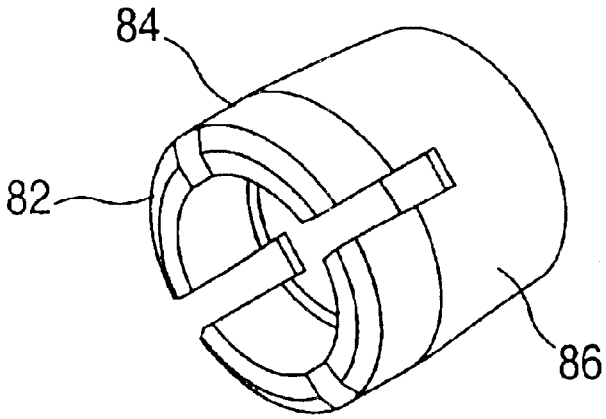
FIG. 5 is a perspective view of the clamping member of the preferred embodiment.
Figure 6:
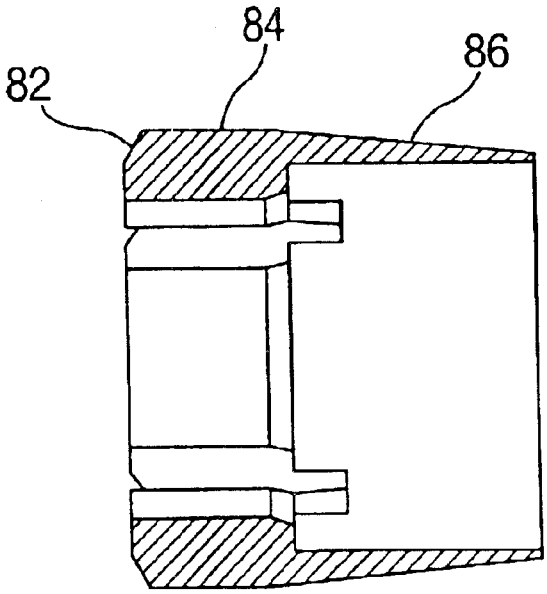
FIG. 6 is a cross-sectional view of the clamping member taken along line 6—6 of FIG. 5.
Figure 7:
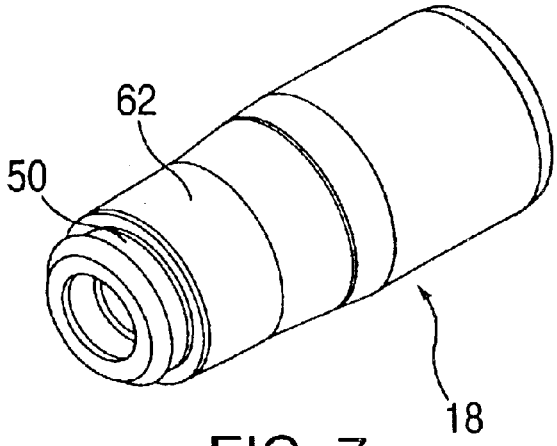
FIG. 7 is a perspective view of the connector body of the preferred embodiment.

With reference to FIGS. 5–6, clamping member 74 is composed of a nonconductive material, such as DELRIN® (although it could be composed of any relatively rigid thermoplastic or a conductive material without affecting the performance of connector 10), and includes a proximal region 80 that has a surface 82 that is correspondingly ramped relative to segments 78, and a distal region 84 that ramps downwardly towards the distal end of body 18. The clamping surface 86 of clamping member is relatively flat, although it could be toothed, wavy, or of some other geometry, and is adapted to engage jacket 30 (although it may also engage a portion of conductor 28) when compression member 20 is moved to its fully compressed position. Clamping member 74 assists in preventing cable 12 from becoming disengaged from body 18, thereby assisting in maintaining good signal transmission between cable 12 and port 14.

Figure 8:
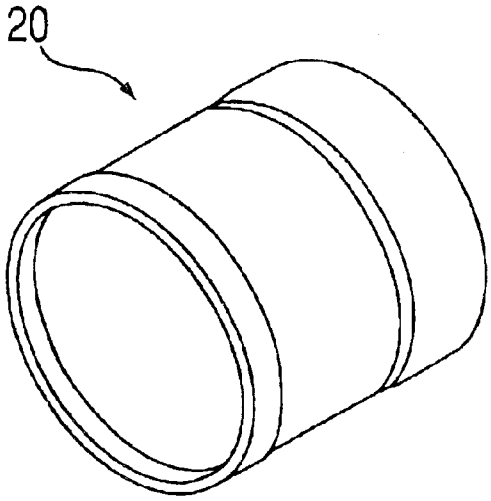
FIG. 8 is a perspective view of the compression body of the preferred embodiment.
Figure 9:
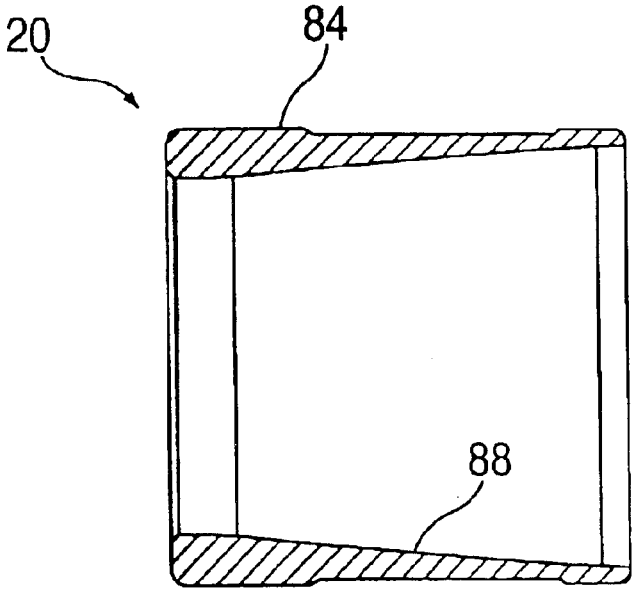
FIG. 9 is a cross-sectional view of the compression body taken along line 9—9 of FIG. 8.
Figure 10:
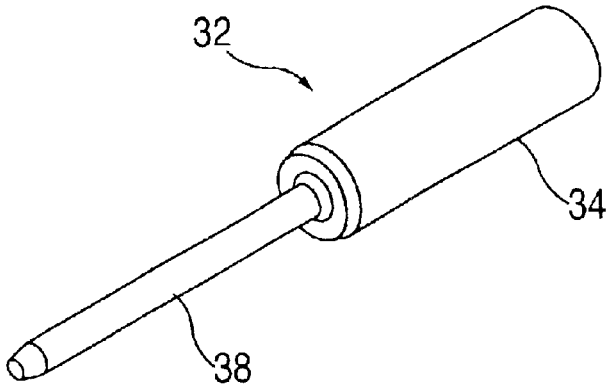
FIG. 10 is a perspective view of the collet assembly of the preferred embodiment.
Figure 11:
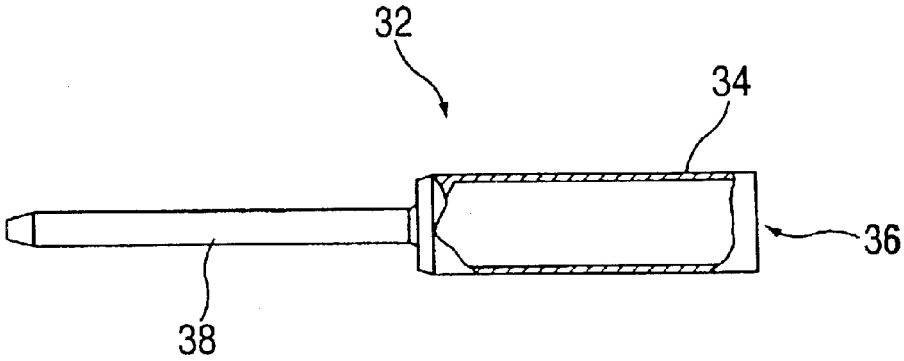
FIG. 11 is a cross-sectional view of the collet assembly taken along line 11—11 of FIG. 10.
Figure 12:
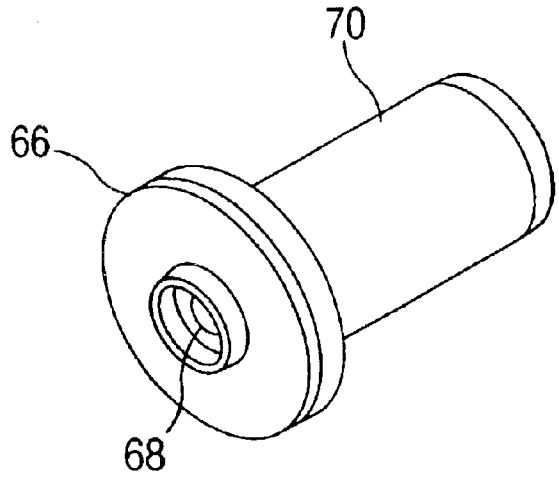
FIG. 12 is a perspective view of the mandrel of the preferred embodiment.
Figure 13:
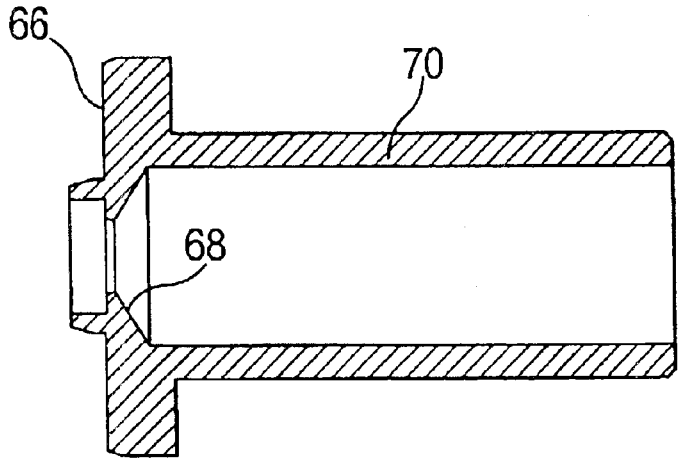
FIG. 13 is across-sectional view of the mandrel taken along line 13—13 of FIG. 12.

With reference to FIGS. 8–9, compression member 20 comprises a wedge shaped piece of durable material, such as brass, that includes a tapering inner surface 88 extending inwardly from its proximal end and that corresponds with the ramped surface of distal region 84. The proximal end of compression member 20 is press fit into the distal end of body 18 with surface 88 positioned in contacting relation to the outwardly facing surface of distal region 84. An industry standard compression tool (such as industry standard RG7/11 with which The Ripley CAT-AS or CAT-AS-EX or EX7/11CAT compression tools all comply) is used to axially slide compression member 20 from its first (uncompressed) to its second (fully compressed) position, as described below.

In operation, a technician would first prepare cable 12 using industry standard preparation tools, such as the Ripley CST-320/7CQRF tool, in a traditional manner by coring out a predetermined amount of dielectric material 26 from between central conductor 24 and outer conductor 28, stripping a predetermined amount of jacket off of outer conductor 28, and removing a predetermined amount of outer conductor 28. The technician would then insert the central conductor through the distal end of body 18 until it is bottomed out in seizing member 34, which simultaneously positions outer conductor 28 between mandrel 70 and RF seal 72. A portion of uncovered outer conductor 28, as well as a portion of conductor 28 with jacket 30 is also positioned between mandrel 70 and clamping member 74.

A compression tool may then be used by the technician to engage the uncompressed compression member 20. The technician actuates the compression tool such that compression member 20 is axially moved towards and into body 18. As compression member 20 axially moves into body 18, its inner surface 88 engages the ramped surface of distal region 84, while the outwardly facing surface of compression member 20 is bounded by the inner surface of body 18. Inner surface 88 therefore exerts an inwardly directed radial force to clamping member 74, thereby causing clamping surface 86 to engage outer conductor 28/jacket 30. The axial movement of compression member 20 also axially drives clamping member into engagement with RF seal 72. As the ramped surface at the proximal end of clamping member 74 engages correspondingly ramped distal surface of segments 78, the opposing ramped surface of segments 78 engage the ramped inwardly facing surface of connector body 18 which, in turn, exert an inwardly directed radial force to RF seal 72. Once compression member 20 reaches it second (fully compressed) position, RF seal 72 is securely engaged with outer conductor 28, and clamping member 74 is in secure engagement with outer conductor 28/jacket 30, as illustrated in FIG. 3*b*. If maintenance needs to be performed to box 12, the technician merely disconnects connector 12 therefrom by unthreading coupling nut 22. There is no need for the technician to remove cable 12 from body 18, thereby accelerating the rate at which repair and maintenance can be completed.

Figure 14:
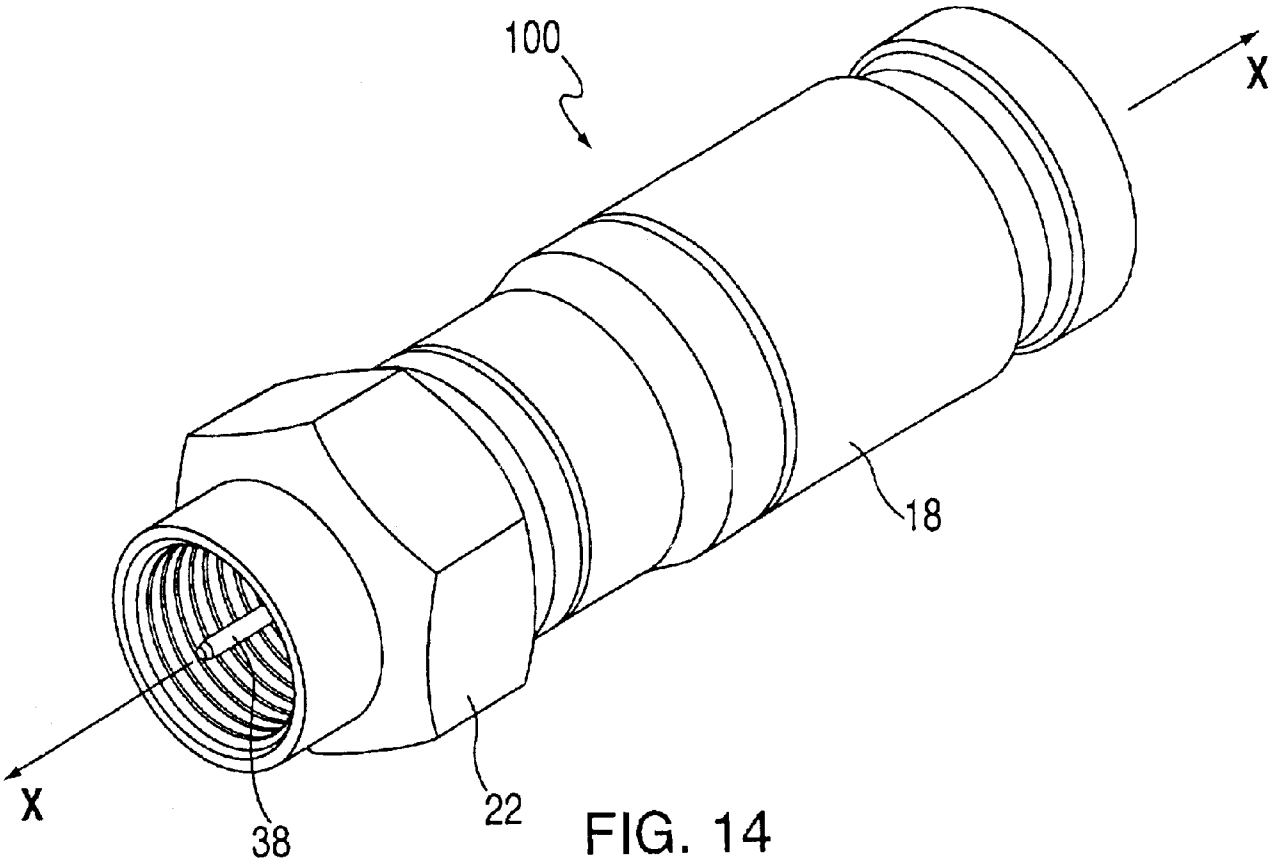
FIG. 14 is a perspective view of a second embodiment of the present invention.
Figure 15:
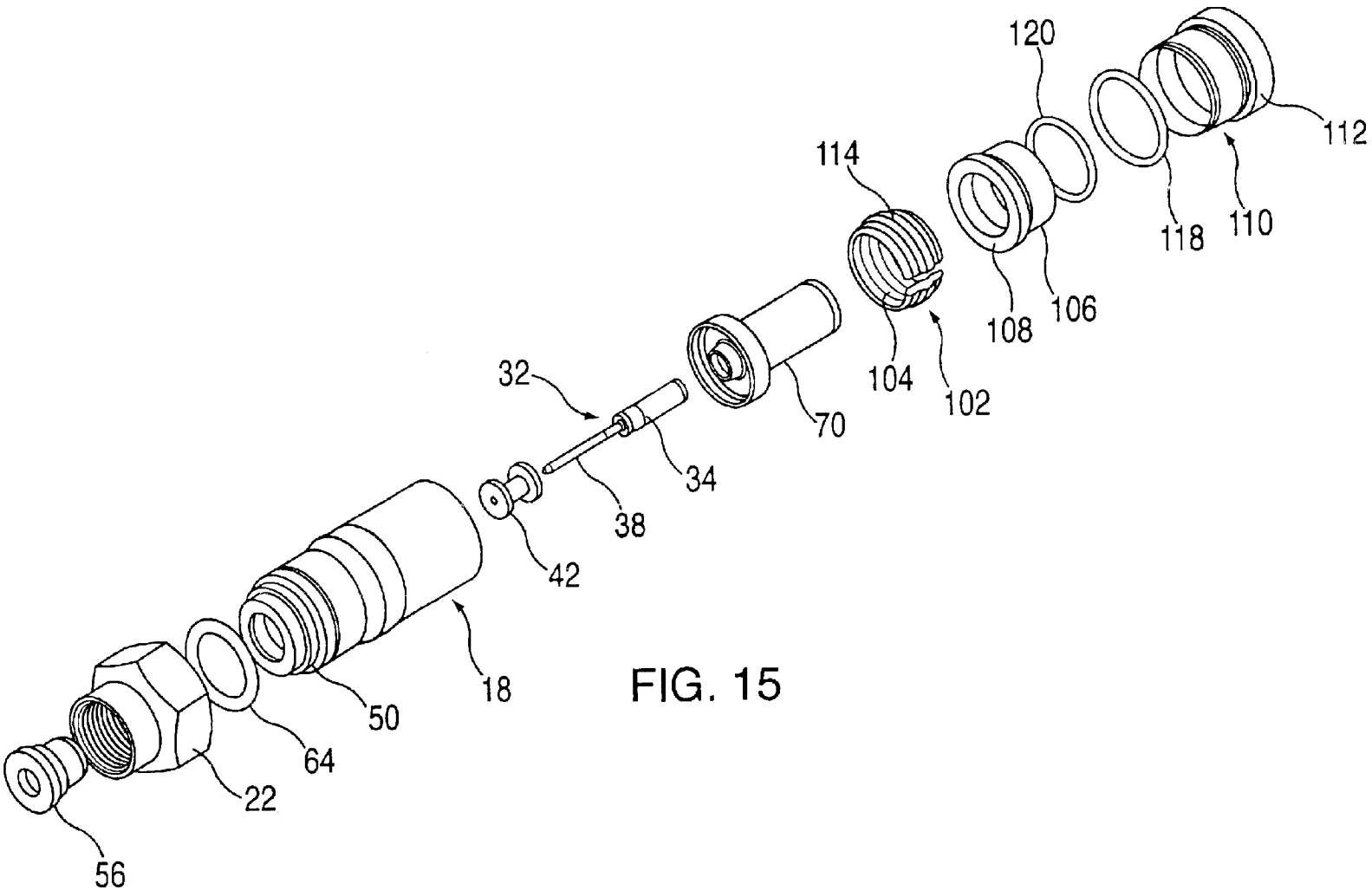
FIG. 15 is an exploded perspective thereof.
Figure 16:
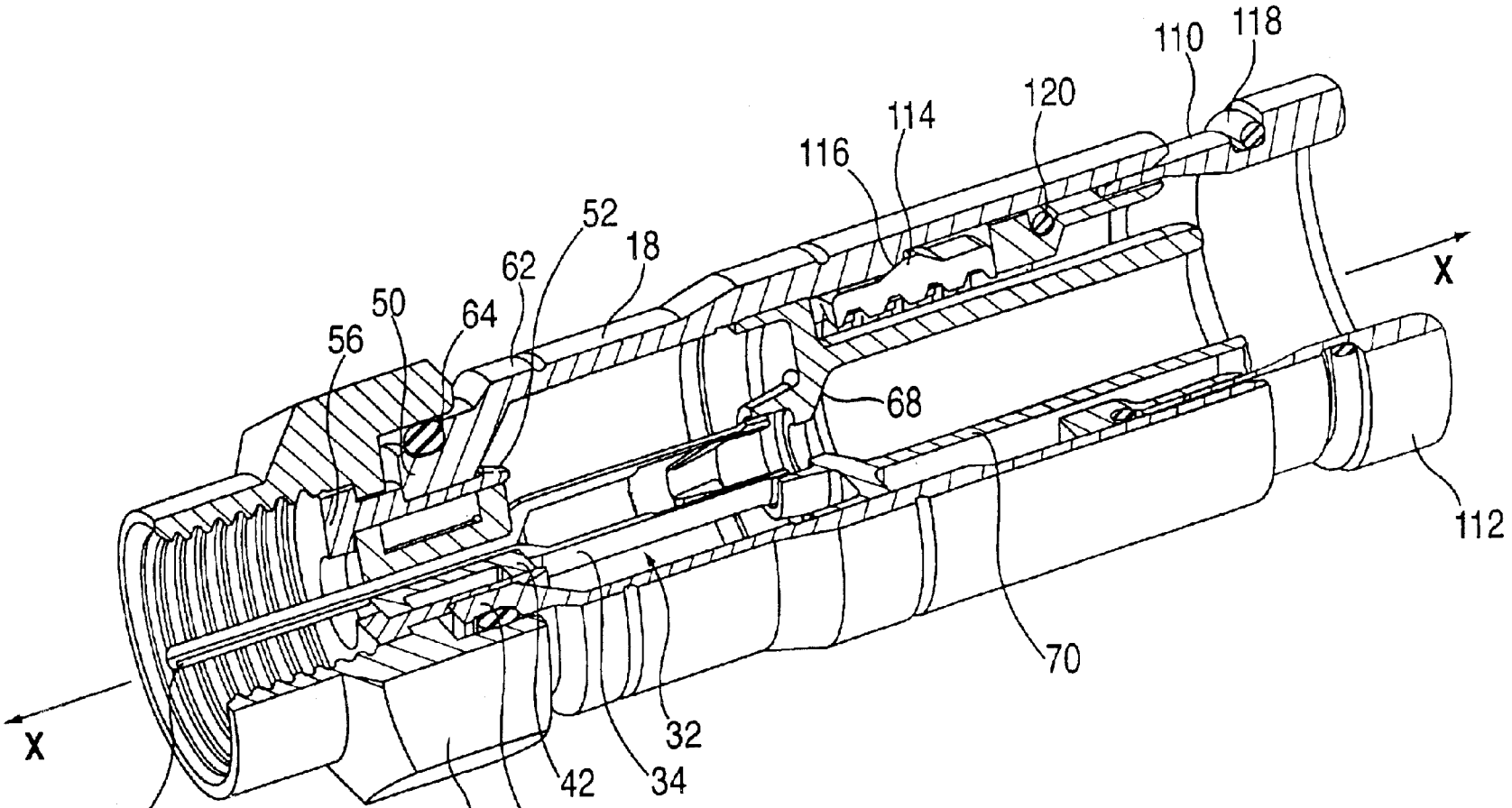
FIG. 16 is a cross-sectional view thereof taken along line 16—16 of FIG. 14.

An alternate embodiment of connector 10, designated 100, is illustrated in FIGS. 14–16. Most of the elements between connectors 10 and 100 are virtually identical and will therefore be represented by common reference manuals. In addition, the operation/functionality of connector 100 is virtually identical to the operation/functionality of connector 10, and will therefore not be repeated.

The principal distinctions between connectors 10 and 100 are that connector 100 includes an RF seal 102 comprising a split ring with several axially spaced rows of circumferentially spaced teeth 104 protruding from its inwardly facing surface, a clamping member 106 that includes a relatively flat proximal end surface 108 that is designed to engage and axially drive RF seal 102; and compression member 110 includes a distal end 112 that is of a diameter greater than that of body 18, thereby serving as a compression stop.

RF seal 102 includes teeth 104, and a ramped portion 114 formed on its outer surface that abuts a correspondingly ramped surface 116 of body 18. As the proximal end of clamping member 106 engages and axially drives RF seal 102, the ramped surface 114 forces RF seal 102 radially inward and into engaging relation with outer conductor 28.

When compression member 110 is moved to its second position, its flanged distal end 112 comes into abutting relation with the distal end of body 18. To seal out moisture from infiltrating between body 18 and compression member 110, an O-ring 118 is sealingly positioned between the two.

In addition, due to the shape of clamping member 106, an O-ring 120 is disposed in an annular notch formed therein, and that it is positioned between compression member 110 and clamping member 106 to prevent migration of moisture therebetween.

Figure 17:
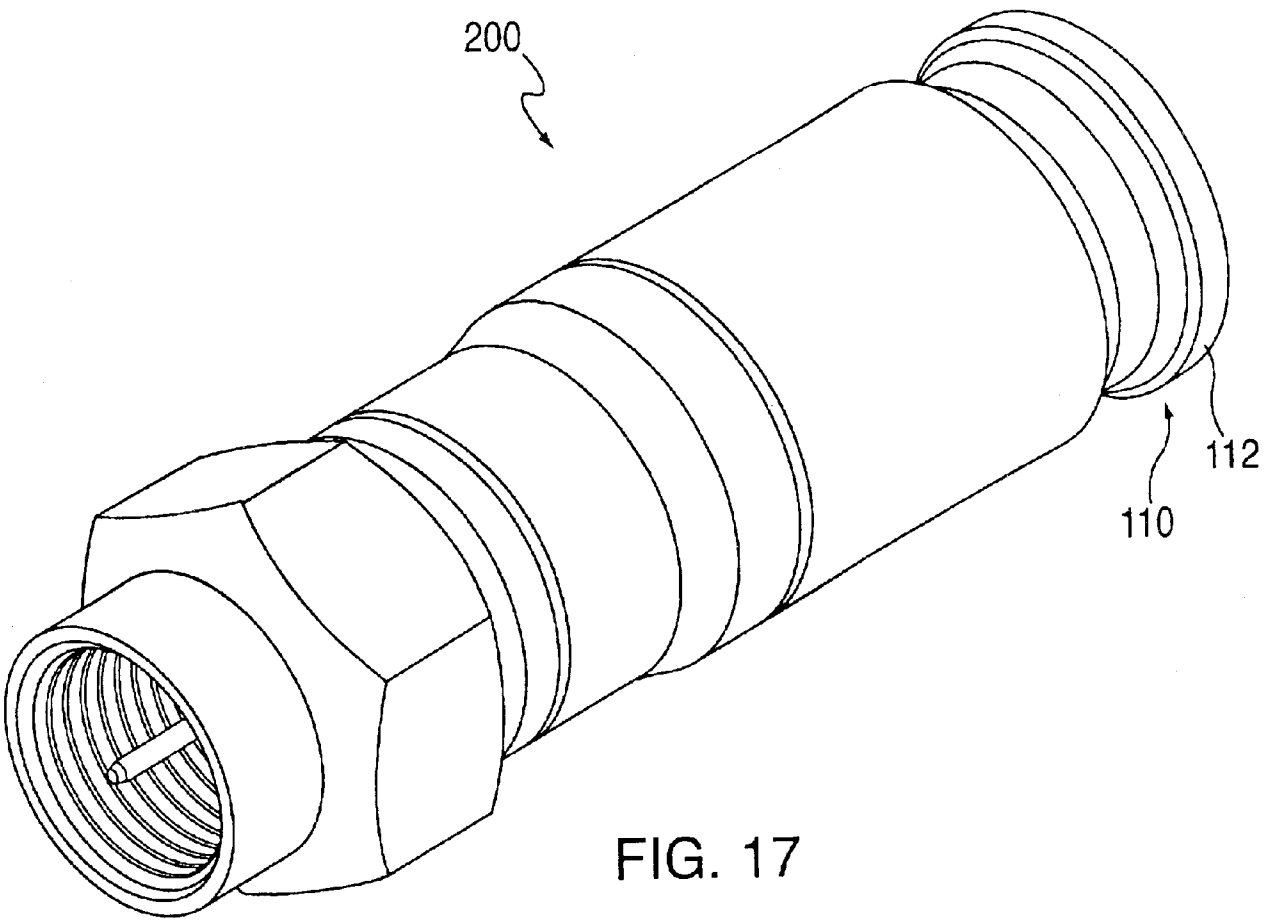
FIG. 17 is a perspective view of a third embodiment of the present invention.
Figure 18:
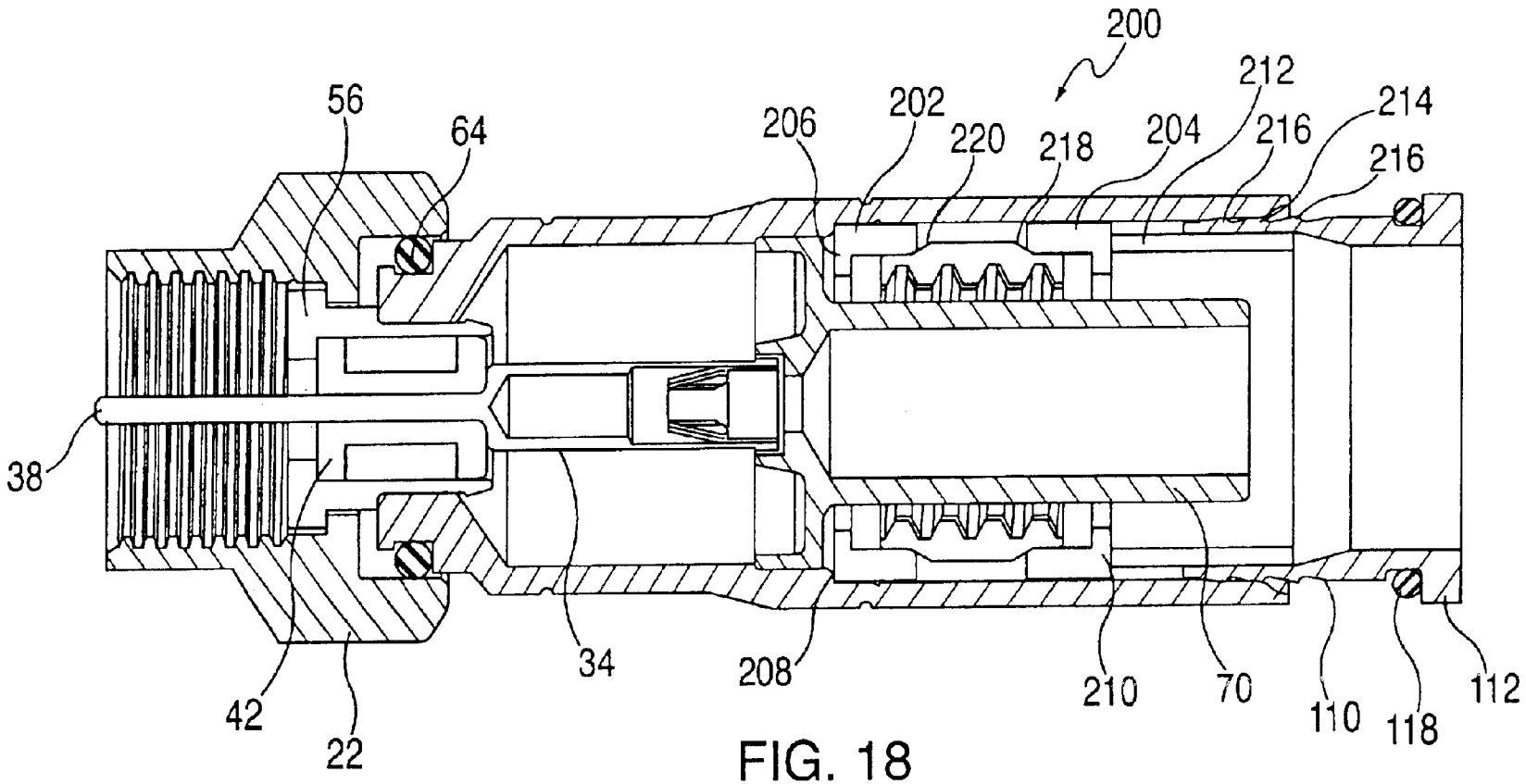
FIG. 18 is a cross-sectional view thereof taken along line 18—18 of FIG. 17.

Referring now to FIGS. 17–18, another alternate embodiment is illustrated. Connector 200 includes many common connecting elements as connectors 10 and 100, all of which will not be described in further detail and which will be represented by common reference numerals.

Connector 200 includes the same RF seal?102 as used with connector 100. However, as opposed to an inner surface of body 18 being the radial driving member, connector 200 includes a pair of flanged bushings 202, 204 that are securely positioned within body 18 on opposite sides of RF seal 102. The flange 206 of bushing 202 abuts a shoulder 208 formed on the interior surface of body 18, while the flange 210 of bushing 204 abuts a tubular compression guide 212 when compression member 110 is uncompressed. Tubular compression guide 212 is co-axially positioned within body 18 and is annularly spaced relation to mandrel 70.

Compression member 20 includes a serrated compression leg 214 that is slidingly positioned between the interior surface of body 18 and the outer surface of tubular compression guide 212. The serrations 216 on leg 214 extend rearwardly to assist in preventing rearward movement of compression member 20.

In operation, as compression tool (not shown) forces compression member 20 axially into body 18, the leading edge of leg 214 engages the flange 210 of bushing 204 and drives it axially. The end of bushing 204 then engages the distal ramped surface 218 of RF seal 102, exerting both an axial force as well as a radial force to RF seal 102. As a consequence of the axial force, the proximal ramped surface 220 of RF seal engages and is driven radially inward by the end of bushing 202. When compression member 20 reaches its fully compressed position, the teeth 104 of RF seal are sealingly engaged with outer conductor 28.

Figure 19:
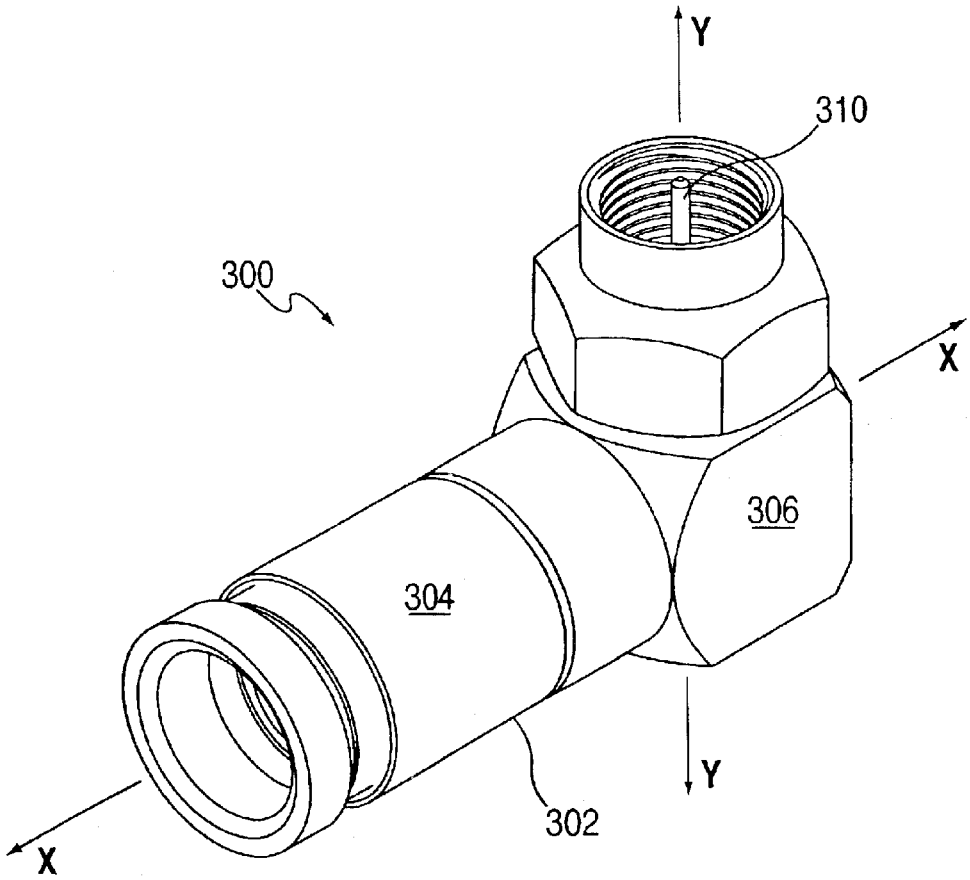
FIG. 19 is a perspective view of a fourth alternate embodiment of the present invention.
Figure 20:
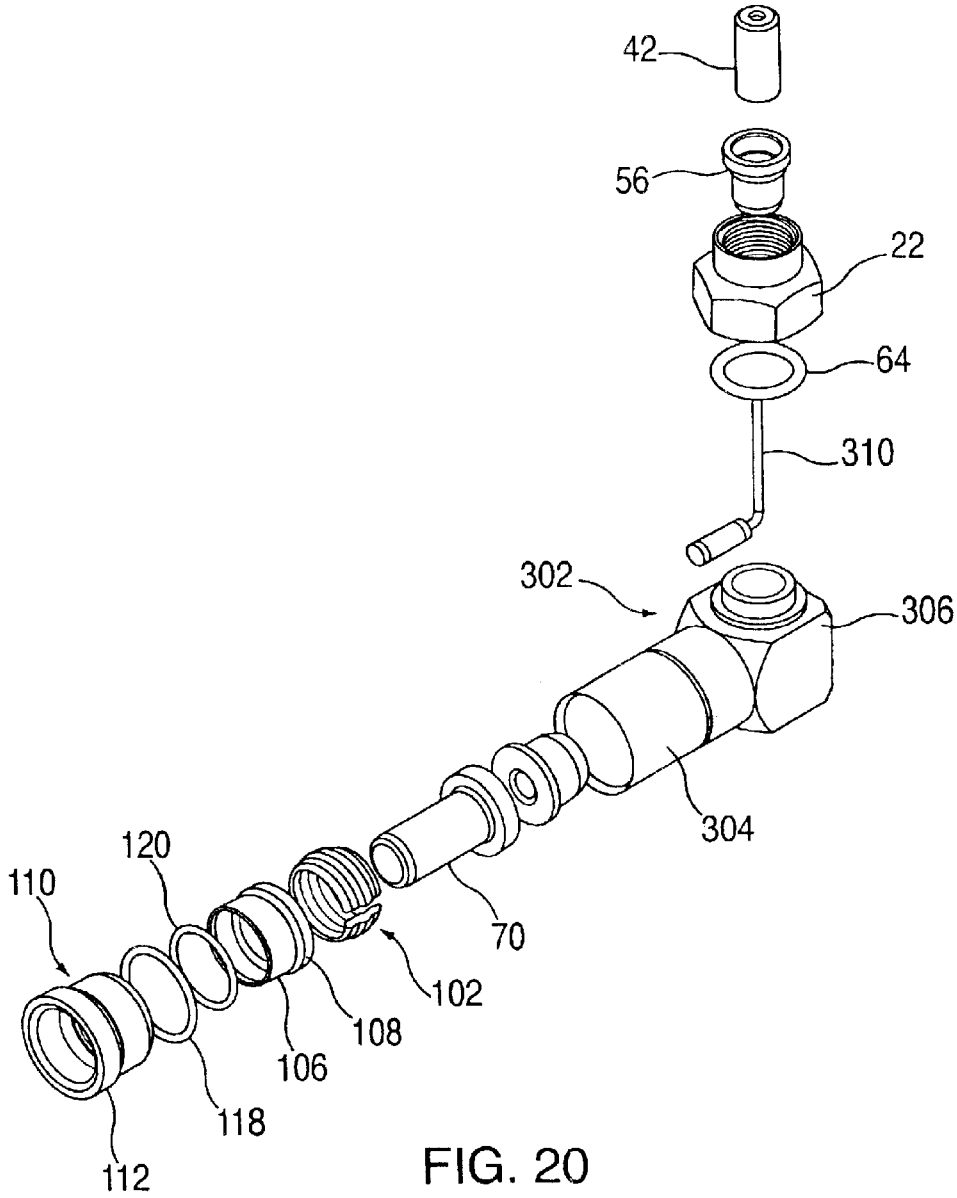
FIG. 20 is an exploded perspective thereof.
Figure 21:
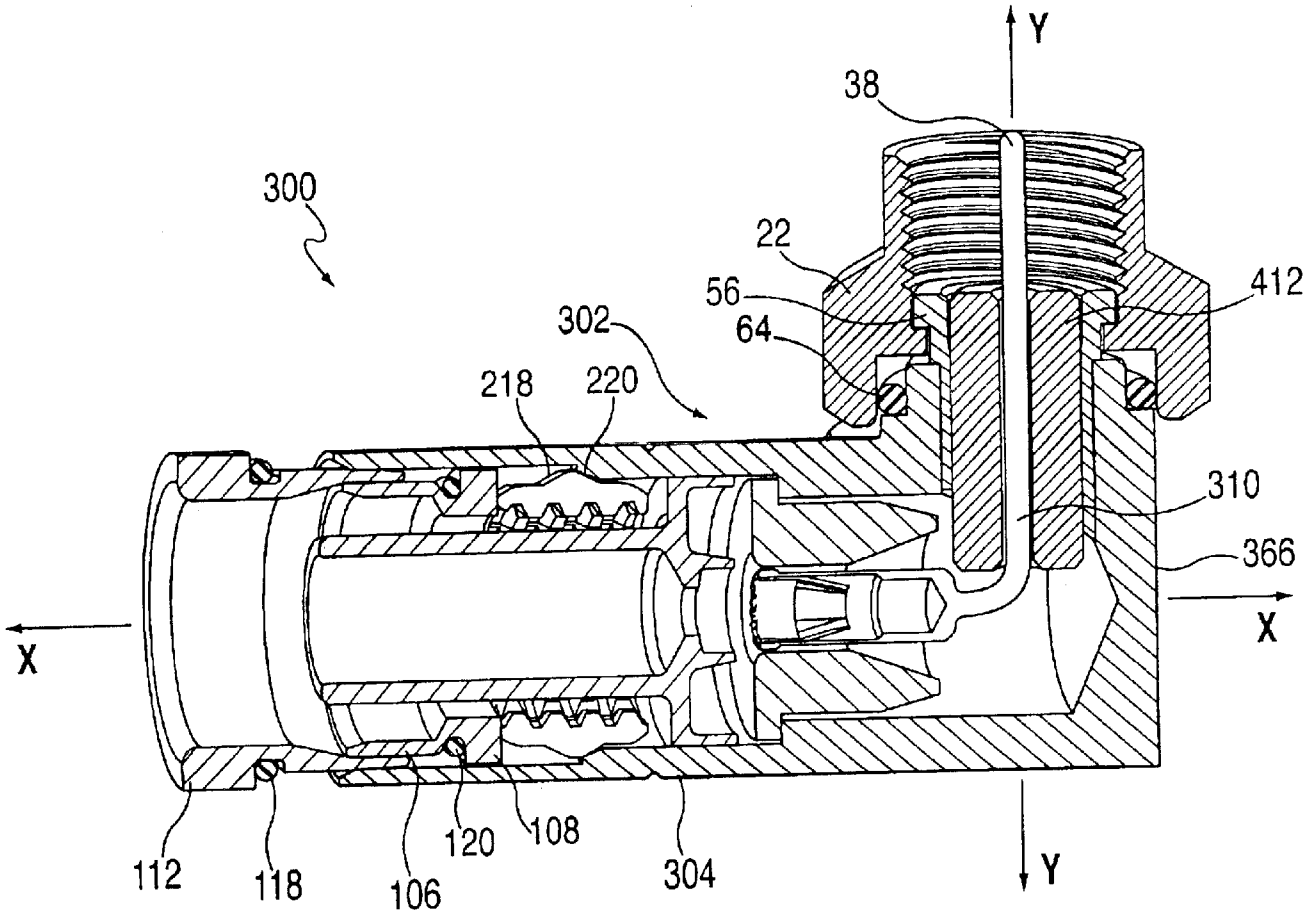
FIG. 21 is a cross-sectional view thereof taken along line 21—21 of FIG. 19.

With reference to FIGS. 19–21, an alternate embodiment illustrating a connector 300 that is useful for interconnecting to ports that are either angularly offset relative to the direction in which cable 12 is extending, or that include impediments that otherwise obstruct a cable's access to the port. Body 302 of connector 300 includes a distal region (cable side) 304 that extends along axis X—X (co-axial with cable 12), and a proximal region (port side) 306 that extends at a 90 degree angle relative to distal region 304 along an axis Y—Y.

The majority of cable connecting and sealing elements are essentially the same as the ones used with connector 100, and are contained within distal region 304. A collet retainer 305 is securely positioned within body distal region 304 and in abutting relation to the proximal end surface of mandrel 70 and in radially surrounding relation to said collet assembly 34. The 90 degree transition between distal region 304 and proximal region 308 is made by a contact pin 308 that extends from collet 309 that is positioned within distal region 304 and through insulator 310 that extends along axis Y—Y in proximal region 308, and ultimately through coupling nut 22.

While a preferred and several alternate embodiments of the present invention have been illustrated and described in detail, it will be apparent that various changes may be made in the discloded embodiment without departing from the scope and spirit of the invention, as define in the appended claims.

What is claimed is:

1. A connector for interconnecting hard-line cable to an equipment port, comprising:

a. an elongated body at least a portion of which extends along a first longitudinal axis, and having proximal and distal ends, an inwardly facing surface, and a ramped surface formed on said inwardly facing surface;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing surface and positioned within and extending co-axially with said body;

e. an RF seal positioned within said body and in annularly spaced relation to said mandrel, and comprising an outwardly facing surface that includes a ramped surface formed thereon that is positioned in contacting relation to said ramped surface of body; and f. a member movably positioned within said body for axial movement relative thereto, and adapted to engage and exert an axial force to said RF seal, whereby said axial force causes said ramped surface formed on said inwardly facing surface of said connector body to exert a radially inward directed force on said RF seal.

2. The connector of claim 1, further comprising a retainer interconnecting said nut to said body.

3. The connector of claim 1, wherein said RF seal further comprises an inwardly facing surface that includes a plurality of axially spaced rows of teeth.

4. The connector of claim 1, further comprising a collet assembly co-axially positioned within said body.

5. The connector of claim 4, wherein said collet assembly comprises a seizing member positioned within said body that includes an opening co-axial with said first longitudinal axis, and a contact pin electrically connected to said seizing member and extending along said longitudinal axis through said proximal end of said body.

6. The connector of claim 5, further comprising a conductor centering guide positioned within said body and adjacent to said seizing member, and including an opening that is co-axial with said longitudinal axis.

7. The connector of claim 1, wherein said body includes at least a portion that extends along a second longitudinal axis that is substantially perpendicular to said first longitudinal axis.

8. The connector of claim 7, further comprising a collet assembly including a seizing member positioned within said body that includes an opening co-axial with said first longitudinal axis, and a contact pin electrically connected to said seizing member and extending along said second longitudinal axis through said proximal end of said body.

9. The connector of claim 1, wherein said RF seal further comprises annularly spaced apart notches formed in said outwardly facing surface.

10. The connector of claim 9, wherein said RF seal further comprises an inwardly facing surface that includes a plurality of axially spaced rows of teeth.

11. A connector for interconnecting hard-line cable to an equipment port, comprising:

a. an elongated body at least a portion of which extends along a first longitudinal axis, and having proximal and distal ends, and a ramped surface formed therein;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing surface and positioned within and extending co-axially with said body;

e. an RF seal positioned within said body and in annularly spaced relation to said mandrel, and comprising an outwardly facing surface that includes a ramped surface formed thereon that is positioned in contacting relation to said ramped surface of body; and f. a clamping member having proximal and distal ends and an outwardly facing surface that tapers downwardly in a direction towards said distal end, and being movably positioned within said body for both axial and radial movement relative thereto, said proximal end of said clamping member adapted to engage and exert an axial force to said RF seal, and said compression member adapted to engage said outwardly facing surface of said clamping member, whereby said compression member exerts both a radial force and an axial force to said clamping member when it moves from its said first terminal position to its said second terminal position.

12. The connector of claim 11, further comprising a retainer interconnecting said nut to said body.

13. The connector of claim 11, wherein said RF seal further comprises an inwardly facing surface that includes a plurality of axially spaced rows of teeth.

14. The connector of claim 11, further comprising a collet assembly co-axially positioned within said body.

15. The connector of claim 14, wherein said collet assembly comprises a seizing member positioned within said body that includes an opening co-axial with said first longitudinal axis, and a contact pin electrically connected to said seizing member and extending along said longitudinal axis through said proximal end of said body.

16. The connector of claim 15, further comprising a conductor centering guide positioned within said body and adjacent to said seizing member, and including an opening that is co-axial with said longitudinal axis.

17. The connector of claim 11, wherein said body includes at least a portion that extends along a second longitudinal axis that is substantially perpendicular to said first longitudinal axis.

18. The connector of claim 17, further comprising a collet assembly including a seizing member positioned within said body that includes an opening co-axial with said first longitudinal axis, and a contact pin electrically connected to said seizing member and extending along said second longitudinal axis through said proximal end of said body.

19. The connector of claim 11, wherein said RF seal further comprises annularly spaced apart notches formed in said outwardly facing surface.

20. The connector of claim 19, wherein said RF seal further comprises an inwardly facing surface that includes a plurality of axially spaced rows of teeth.

21. A connector for interconnecting hard-line cable to an equipment port, comprising:

a. an elongated body at least a portion of which extends along a first longitudinal axis, and having proximal and distal ends, and a ramped surface formed therein;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing surface and positioned within and extending co-axially with said body;

e. an RF seal positioned within said body and in annularly spaced relation to said mandrel, and comprising an inner surface and an outer surface, said outer surface including a first ramped portion formed therein and positioned in contacting relation to said ramped surface of body; and f. a driving member movably positioned within said body for axial movement relative thereto, and adapted to engage and exert an axial force to said RF seal, whereby said RF seal is forced radially inward through the contact between its said first ramped portion and said ramped surface of said body.

22. The connector of claim 21, further comprising a retainer interconnecting said nut to said body.

23. The connector of claim 21, further comprising a conductor centering guide positioned within said body and adjacent to said seizing member, and including an opening that is co-axial with said longitudinal axis.

24. The connector of claim 21, wherein said RF seal further comprises an inwardly facing surface that includes a plurality of axially spaced rows of teeth.

25. The connector of claim 21, wherein said RF seal further comprises a second ramped portion formed in said outer surface, said second ramped portion being positioned opposite to said first ramped portion.

26. The connector of claim 25, wherein said driving member is adapted to engage and produce an inwardly directed radially force to said second ramped portion.

27. The connector of claim 21, wherein said body includes at least a portion that extends along a second longitudinal axis that is substantially perpendicular to said first longitudinal axis.

28. The connector of claim 27, further comprising a collet assembly including a seizing member positioned within said body that includes an opening co-axial with said first longitudinal axis, and a contact pin electrically connected to said seizing member and extending along said second longitudinal axis through said proximal end of said body.

29. The connector of claim 21, further comprising a collet assembly co-axially positioned within said body.

30. The connector of claim 29, wherein said collet assembly comprises a seizing member positioned within said body that includes an opening co-axial with said first longitudinal axis, and a contact pin electrically connected to said seizing member and extending along said first longitudinal axis through said proximal end of said body.

31. A connector for interconnecting hard-line cable to an equipment port, comprising:

a. an elongated body at least a portion of which extends along a first longitudinal axis, and having proximal and distal ends, and a ramped surface formed therein;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing surface and positioned within and extending co-axially with said body;

e. an RF seal positioned within said body and in annularly spaced relation to said mandrel, and comprising an inner surface and an outer surface, said outer surface including a first ramped portion formed therein and positioned in contacting relation to said ramped surface of body; and f. means for exerting an axial force and a radial force to said RF seal; and g. means for exerting a radial force to said RF seal.

32. The connector according to claim 31, wherein said means for exerting an axial force and a radial force to said RF seal comprises a first flanged bushing positioned co-axially within said body and between said compression member and said first ramped surface of said RF seal.

33. The connector according to claim 31, wherein said means for exerting a radial force to said RF seal comprises a second flanged bushing positioned co-axially within said body and in abutting relation to said second ramped surface of said RF seal.

34. The connector of claim 31, further comprising a retainer interconnecting said nut to said body.

35. The connector of claim 31, further comprising a conductor centering guide positioned within said body and adjacent to said seizing member, and including an opening that is co-axial with said longitudinal axis.

36. The connector of claim 31, wherein said RF seal further comprises an inwardly facing surface that includes a plurality of axially spaced rows of teeth.

37. The connector of claim 31, further comprising a collet assembly co-axially positioned within said body.

38. The connector of claim 37, wherein said collet assembly comprises a seizing member positioned within said body that includes an opening co-axial with said first longitudinal axis, and a contact pin electrically connected to said seizing member and extending along said first longitudinal axis through said proximal end of said body.

39. The connector of claim 31, wherein said mandrel includes a proximal end surface.

40. The connector according to claim 39, wherein said means.

41. A connector for interconnecting hard-line cable to an equipment port, comprising:

a. an elongated body at least a portion of which extends along a first longitudinal axis, and having proximal and distal ends;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing positioned within and extending co-axially with said body;

e. an RF seal positioned within said body and in annularly spaced relation to said mandrel, and comprising an inner surface and an outer surface, said outer surface including a first ramped portion formed therein and positioned in contacting relation to said ramped surface of body;

f. a first flanged bushing positioned co-axially within said body and between said compression member and said first ramped surface of said RF seal; and g. a second flanged bushing positioned co-axially within said body and in abutting relation to said second ramped surface of said RF seal.

42. The connector of claim 41, further comprising a retainer interconnecting said nut to said body.

43. The connector of claim 41, further comprising a conductor centering guide positioned within said body and adjacent to said seizing member, and including an opening that is co-axial with said longitudinal axis.

44. The connector of claim 41, wherein said RF seal further comprises an inwardly facing surface that includes a plurality of axially spaced rows of teeth.

45. The connector of claim 41, further comprising a collet assembly co-axially positioned within said body.

46. The connector of claim 45, wherein said collet assembly comprises a seizing member positioned within said body that includes an opening co-axial with said first longitudinal axis, and a contact pin electrically connected to said seizing member and extending along said first longitudinal axis through said proximal end of said body.

47. A connector for interconnecting hard-line cable to an equipment port, comprising:

a. an elongated body at least a portion of which extends along a first longitudinal axis, and having proximal and distal ends, and a ramped surface formed therein;

b. a compression member interconnected to said body adjacent the distal end thereof, and adapted for axial, sliding movement between first and second terminal positions relative to said body;

c. a nut interconnected to said body, adjacent the proximal end thereof, and adapted for rotation relative to said body about said longitudinal axis, said nut adapted to couple said connector to said equipment port;

d. a mandrel having an outwardly facing surface, and positioned within and extending co-axially with said body;

e. an RF seal positioned within said body and in annularly spaced relation to said mandrel, and comprising an inner surface and an outer surface, said outer surface including a first ramped portion formed therein and positioned in contacting relation to said ramped surface of body; and f. means for exerting an axial force to said RF seal; and g. means for exerting a radial force to said RF seal.

48. The connector according to claim 47, further comprising a clamping member having a proximal end surface and positioned within said body in at least partially, radially surrounding relation to said mandrel and between said RF seal and said compression member.

49. The connector according to claim 48, wherein said means for exerting an axial force to said RF seal comprises said proximal end surface of said clamping member positioned in abutting relation to said RF seal, whereby axial movement of said clamping member by said compression member causes an axial force to be exerted upon said RF seal.

50. The connector according to claim 49, wherein said means for exerting a radial force to said RF seal comprises said ramped surface formed in said body contacting said ramped surface on said RF seal, whereby said axial force exerted upon said RF seal by said clamping member causes said ramped surface in said body to exert an inwardly directed radial force on said RF seal.

* * * * *